US005470073A

United States Patent [19]

Vasquez

[11] Patent Number: 5,470,073

[45] **Date of Patent: * Nov. 28, 1995**

[54] GOLF INSTRUCTIONAL DEVICE

[76] Inventor: Jose C. Vasquez, 2508 Torrey Pines, Fort Worth, Tex. 76109

[ * ] Notice: The portion of the term of this patent subsequent to Apr. 20, 2010, has been disclaimed.

[21] Appl. No.: 60,320

[22] Filed: May 11, 1993

Related U.S. Application Data

[60] Continuation-in-part of Ser. No. 27,400, Mar. 8, 1993, Pat. No. 5,320,354, which is a division of Ser. No. 862,880, Apr. 3, 1992, Pat. No. 5,203,568.

[51] Int. Cl.[6] ..... A63B 69/36

[52] U.S. Cl. ..... 273/187.2; 273/189 R; 273/165

[58] Field of Search ..... 273/187.2, 189 R, 273/194 R, 186.2, 165, 166, 162 R, 186.1, 187.4, 187.5, 191 R, 192

[56] References Cited

U.S. PATENT DOCUMENTS

| | | | |
|---|---|---|---|
| 2,273,416 | 2/1942 | Norwood | 273/35 |
| 3,951,416 | 4/1976 | Koch et al. | 273/183 B |
| 4,781,382 | 11/1988 | Hargraves | 273/183 B |
| 4,944,516 | 7/1990 | Bickler | 273/183 B |
| 5,085,437 | 2/1992 | Leitao | 273/183 B |
| 5,145,179 | 9/1992 | Breed | 373/189 |
| 5,163,685 | 11/1992 | Rhodes | 273/187.5 |
| 5,203,568 | 4/1993 | Vasquez | 273/189 R |

*Primary Examiner*—George J. Marlo
*Attorney, Agent, or Firm*—Robert A. Felsman; Mark D. Perdue

[57] ABSTRACT

An improved golf instructional device with a support member adapted to be held against a conventional or standard golf club. A cap is secured to the support member. A pair of links are formed integrally with and extend from the cap. An arm pad is formed integrally on each generally opposite end of each of the links so that both arms are properly and unalterably positioned relative to the grip and the club. The improved golf instructional device is integrally formed of a conventional material.

9 Claims, 3 Drawing Sheets

GOLF INSTRUCTIONAL DEVICE

REFERENCE TO RELATED APPLICATION

This is a continuation-in-part of application Ser. No. 08/027,400, filed Mar. 8, 1993, now U.S. Pat. No. 5,320,354 which is a divisional application of application Ser. No. 07/862,880 filed Apr. 3, 1992, now U.S. Pat. No. 5,203,568.

BACKGROUND OF THE INVENTION

1. Field of the Invention

This invention relates to golf instructional or training devices used to improve putting and other strokes around the green.

2. Background Information

The act of putting is arguably the most important process in the game of golf. Normally, half the golfer's score is devoted to the task of putting. Golf courses always allow two strokes on every hole for putting while defining the score of par. Any activity geared towards perfecting the art of putting has enormous effects on a golfer's overall score. All golfers strive for total perfection in this area.

Golf is a game of motion. When a golfer begins play on a golf hole, the objective is clear. The ball must be advanced into a small cup a great distance away. The process of striking the golf ball and carrying it great distances requires a great deal of body motion, but eventually that motion must cease. As the golfer moves closer to the cup, precision in distance and direction must be improved or the goal will not be achieved. Because putting is generally the last swing motion, it is considered the most precise activity.

A number of golf instructional devices have been suggested for the improvement of strokes around the green. Some of them connect a golfer's arm or wrist to the club with a linkage to prevent wrist movement or "breaking" during the stroke. Many of the best putters advocate the use of only the arms during the putting stroke to prevent the errant putts that results from breaking the wrist near the point of impact.

One instructional device is disclosed by Norwood in his U.S. Pat. No. 2,273,416. He used a retaining member that fit against the grip of a golf club to be held by the golfer below the end of the shaft and grip. The retaining member has a pivotable link with an arm or wrist band through a spacer to prevent wrist breakage during a stroke. This device interferes with normal hand position while gripping the club. He uses a strapped pad that creates a static angle that may not be comfortable to different size golfers. Also, the left wrist (of a right hand player) is ignored although it provides all the directional motion involved in a stroke or swing.

A variation of Norwood is disclosed by Bickler in his U.S. Pat. No. 4,944,516 which uses a J-hook shaped member designed to engage a hole found in the top of a standard putter grip. An angled attachment member extends upwardly from the J-hook member to support an arm or wrist guide. This device has the same disadvantages found in Norwood.

Previously known golf instructional devices have focused on only a segment of the putting function. These devices were attached to the putter or engaged the golfer in such a manner as to compromise feel and posture. To use these devices, a golfer must adapt to unusual or unnecessary positions.

For a training device to be helpful it must allow the user to complete the task without constraints, if the task is properly performed. Only when an incorrect action is performed should the user be confronted.

Every golfer has a different approach to putting. The motion is acutely affected by each player's physical characteristics. The golfer's normal grip, posture, and feel should not be affected by the instructional or trainer device. Yet the overall goal of limiting body motion should be controlled by the design of the device.

The position of the trainer above and beside the putter grip should make it comfortable for the golfer to use during a practice session.

SUMMARY OF THE INVENTION

It is the general object of the invention to provide an improved golf instructional device used as a putting training device.

In accordance with this object, my improved golf instructional device is integrally formed and has a support member adapted to be held against a conventional or standard golf club, a cap secured to the support member and a pair of links extending from the cap. An arm pad is supported on one end of each link so that both arms are properly and unalterably positioned relative to the grip and the club. Preferably, the coupler is also provided with an elastomeric member to frictionally engage the top of the grip for better engagement between the device and the club.

The above as well as additional objects, features and advantages of the invention will become apparent in the following description.

DESCRIPTION OF THE PREFERRED EMBODIMENT

Figure 1:
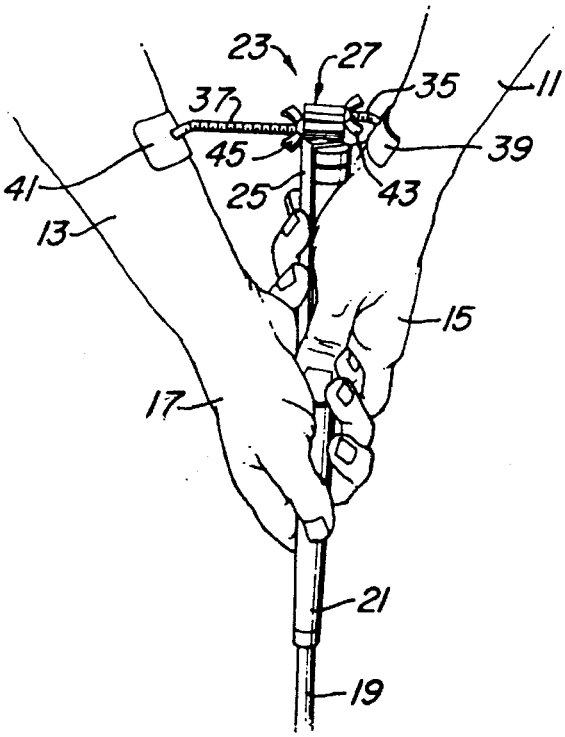
FIG. 1 is a perspective view of a golfer's hands holding a putter and the golf instructional device of the present invention.
Figure 2:
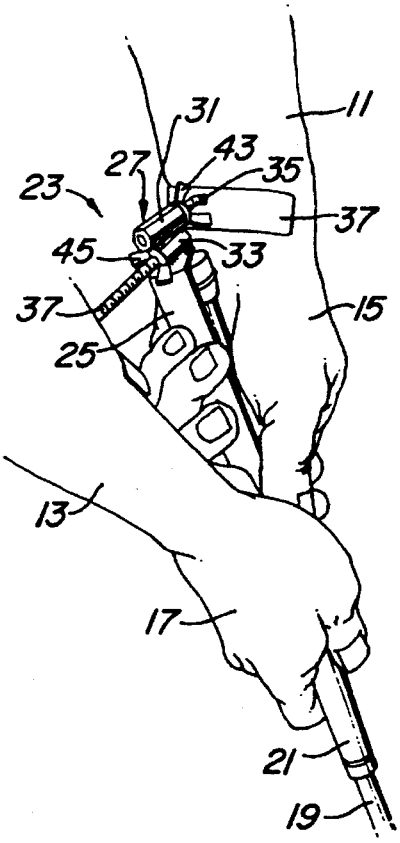
FIG. 2 is a perspective view from a different angle of a golfer's hands holding the golf instructional device of the present invention.

Referring to the drawings, the numerals 11 and 13 in FIGS. 1 and 2 designate the left and right forearms of a golfer holding with hands 15, 17 a golf club 19 and conventional grip 21 and a golf instructional device 23 that is constructed in accordance with the principles of the invention.

Figure 3:
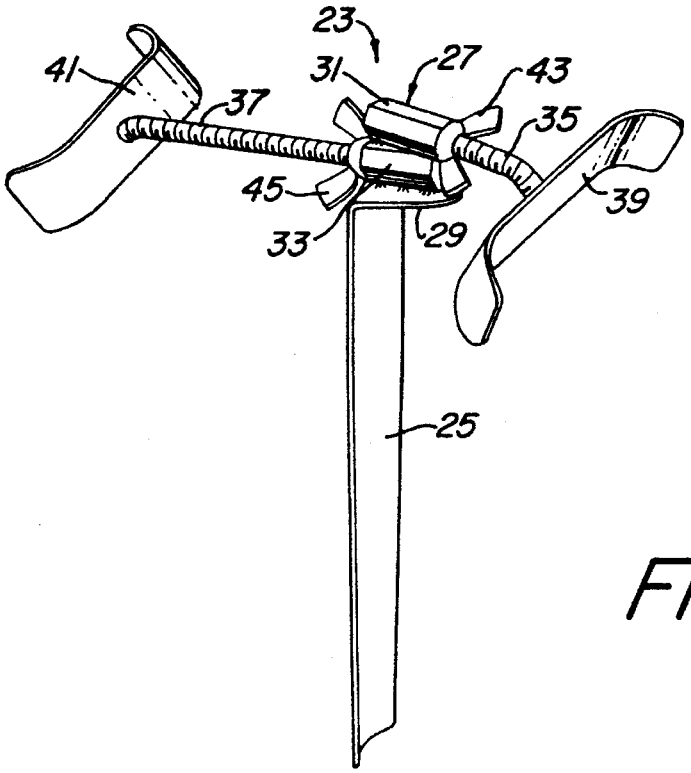
FIG. 3 is an enlarged perspective view of the golf instructional device of FIG. 1.

As best seen in the perspective view of FIG. 3, the instructional device or trainer has a support member 25 in the form of an arcuate gripper plate adapted to be held against and parallel to the grip 21 of the club 19 by a practicing golfer.

A coupler 27 secured to a cap 29 that extends laterally from the upper end of the support member 25 to engage the upper end of the grip 21. The coupler 27 this instance has upper and lower hexagonal nuts or collars 31, 33 (see FIG. 3), each with a threaded opening (not shown). Threaded into each hexagonal collar 31, 33 is a respective link 35, 37 of adjustable length, each being threaded for rotation to a selected position in the threaded opening of the receiving collar. Secured to respective end of the links 35, 37 is an arm pad 39, 41 to engage and position, as shown in FIGS. 1 and 2, the forearms, wrists and hands of the golfer.

Thus, the support member 25 is adapted to be held against and parallel to the grip 21 of the club 19 by the practicing golfer. The coupler 23 is secured to the upper end of the support member 25, and the first link 35 has one end connected to the coupler and the other end extending from the coupler a selected distance transversely from the support member. A first arm pad 39 is secured to the first link 35 to position the golfer's left arm, wrist and hand to the grip and club in an unalterable position.

A second link 37 has one end connected to the coupler 27 and the other end extending from the coupler a selected distance transversely from the support member opposite the first link 35. A second arm pad 41 is secured to the second link 33 to position the right arm, wrist and hand of the golfer relative to the grip and club in an unalterable position.

Each of the links 35, 37 has an adjustable length because of the threaded connection with the interior threaded opening of the upper and lower hexagonal nuts 31, 33 of the coupler 27. A jam nut, here in the form of a wing nut 43, 45 is used to fix the position and length of the associated link once the selected length is established.

Before practice, the length of each link 35, 37 is adjusted to match the physical characteristics of the golfer. The arm pads 39, 41 extend transversely from the upper end of the gripper plate 25 when the hands are used to hold the gripper plate 25 against the grip 21 to establish an unalterable position of the forearms, wrists and hands with respect to the grip 21 and club 19. This necessitates the use of only arm movement during a putting stroke, and further, establishes one relationship of both arms with respect to the grip 21 and club 19. This eliminates wrist movement and relative movement between the arm, with increased accuracy.

Figure 4:
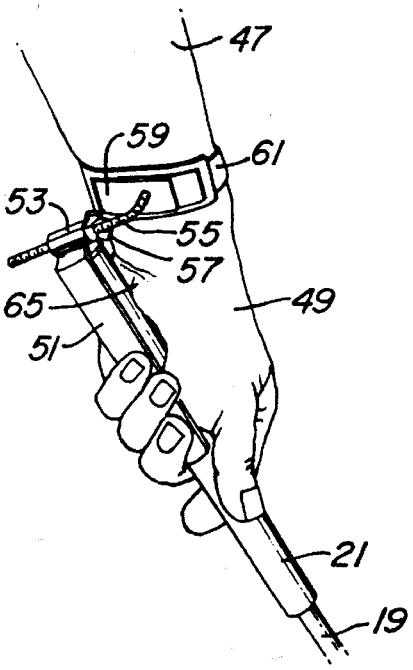
FIG. 4 is a perspective view of the left hand of a golfer holding the golf instructional device of the present invention used as a chipping trainer.
Figure 5:
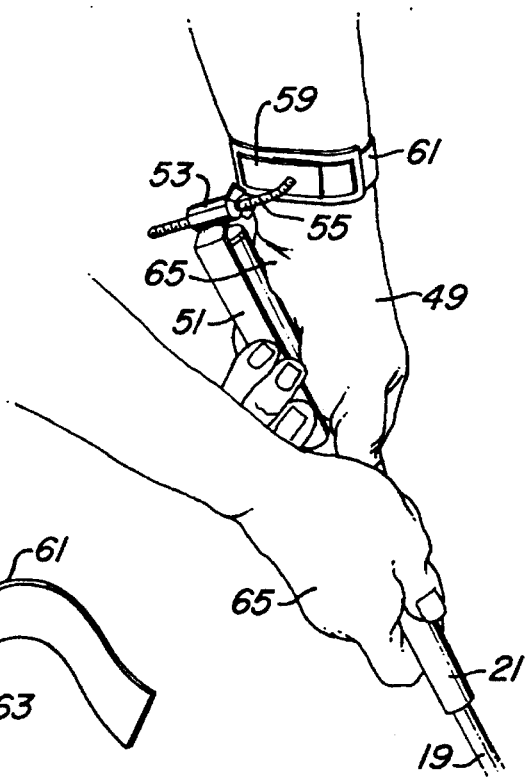
FIG. 5 is a perspective view of both hands of a golfer using the chipping training device of FIG. 4.
Figure 6:
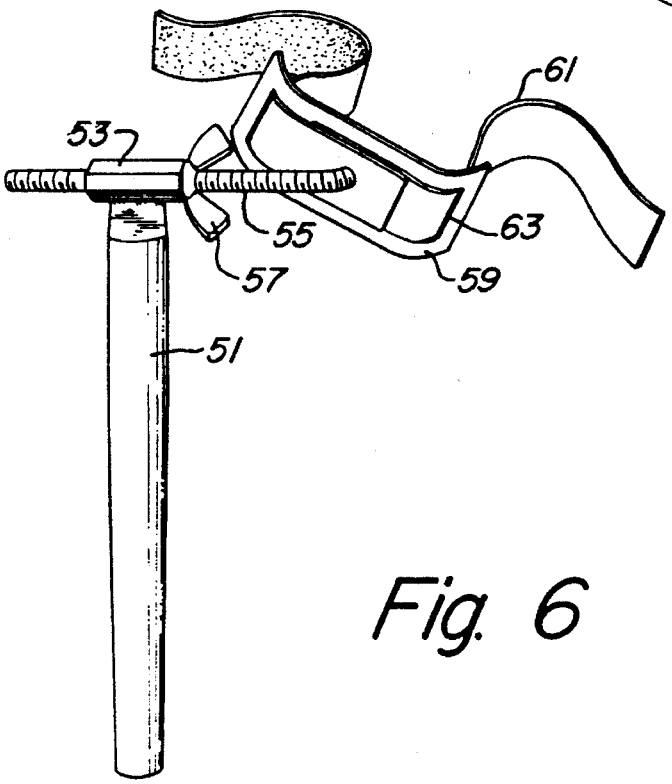
FIG. 6 is a side elevational view of the chipping training device of FIGS. 4 and 5.

FIGS. 4, 5, and 6 illustrate the use of the invention in another form as a chipping trainer. In FIG. 4 is illustrated the left forearm 47 of a golfer and the left hand 49. The left hand is shown with three fingers grasping the support member or gripper plate 51 in a parallel relationship with respect to the grip 21 of club 19. Extending from the upper end of gripper plate 51 is a coupler 53 having an interior threaded opening (not shown) to receive a threaded bolt 55, the length of which can be adjusted by rotation of the bolt and fixed by the wing nut 57. The opposite end of the bolt is secured to an arm pad 59, which has a strap 61 that extends through a plurality of slots 63 to be secured around the wrist of the golfer and held with "Velcro" or other suitable fastener means.

In FIG. 5 the golfer is shown with both hands 49, 65 on the grip 21 of club 19. The position of the arm pad 59 in relation to the grip 21 necessitates that the golfer uses the left hand 49 such that grip extends diagonally across the hand and engages the pad 65 of the hand, which is the appropriate grip for chipping or pitching. There is only one arm pad used on the left arm and none on the right arm to permit rotational movement of the arms during the swing.

Figure 7:
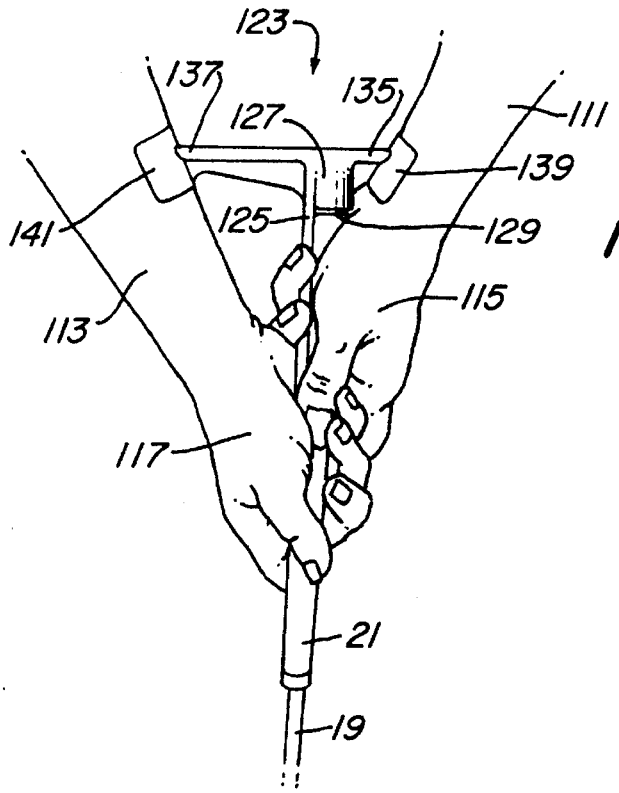
FIG. 7 is a perspective view of a golfer's hands holding a putter and the golf instructional device of the present invention.
Figure 8:
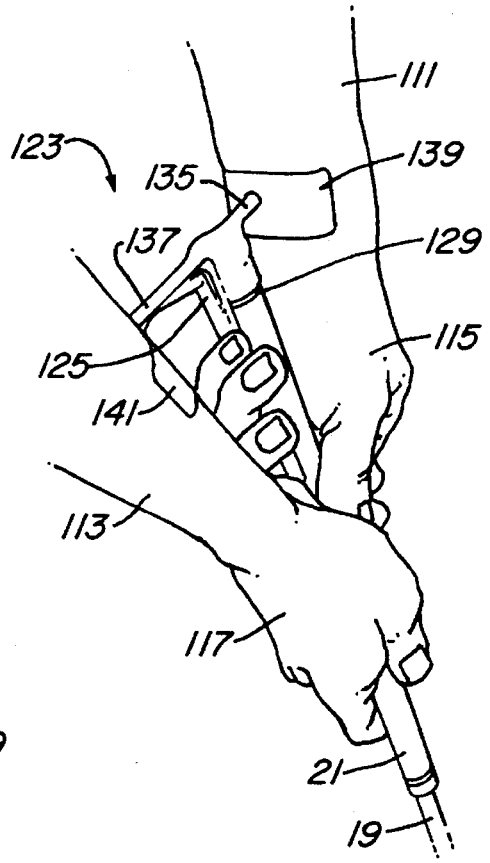
FIG. 8 is a perspective view from a different angle of a golfer's hands holding the golf instructional device of the present invention.
Figure 9:
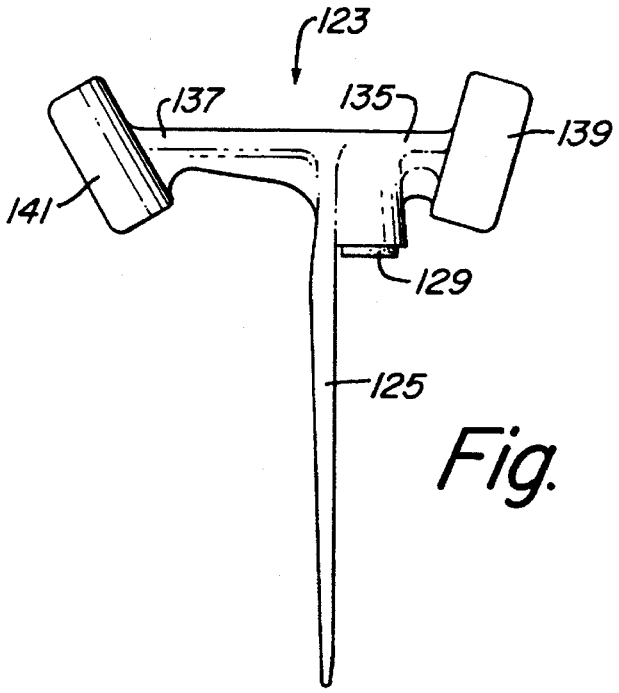
FIG. 9 is an enlarged perspective view of the golf instructional device of FIGS. 7 and 8.

Referring to the FIGS. 7, 8, and 9, the numerals 111 and 113 in FIGS. 7 and 8 designate the left and right forearms of a golfer holding with hands 115, 117 a golf club 19 and conventional grip 21 and a golf instructional device 123 that is constructed in accordance with the principles of the invention. This embodiment of the present invention is integrally molded or formed of plastic, aluminum, steel or other conventional material or a combination thereof.

As best seen in the perspective view of FIG. 9, the instructional device or trainer has a support member 125 in the form of an arcuate gripper plate adapted to be held against and parallel to the grip 21 of the club 19 by a practicing golfer. Because of its length and thus its susceptibility to bending stress, gripper plate 125 preferably is formed of a high-strength metallic material, such as steel or aluminum, the remainder of device 123 being formed of lighter, less expensive material, such as plastic, molded around gripper plate 125. Preferably gripper plate 125 is provided with an elastomeric member 131, which improves frictional engagement between gripper plate 125 and grip 21 of club 19.

A cap 127 is secured to the upper end of the support member 125 to engage the upper end of the grip 21. The cap 127 in this instance is provided with an elastomeric member 129, similar to a conventional rubber washer, for increasing frictional engagement between coupler 127 and grip 21 of club 19. Extending generally laterally or traversely from cap 127 is a linking means, in this case a pair of links 135, 137 of fixed length. Secured to each respective end of the links 135, 137 is an arm pad 139, 141 to engage and position, as shown in FIGS. 1 and 2, the forearms, wrists and hands of the golfer.

Thus, the support member 125 is adapted to be held against and parallel to the grip 21 of the club 19 by the practicing golfer. The cap 127 is formed integrally with the upper end of the support member 125, and the first link 135 has one end integrally connected to the cap 127 and the other end extending from the cap 127 a selected distance transversely from the support member 125. A first arm pad 139 is formed integrally with the first link 135 to position the golfer's left arm, wrist and hand to the grip and club in an unalterable position.

A second link 137 has one end integrally connected to the cap 127 and the other end extending from the cap 127 a selected distance transversely from the support member 125 and generally opposite the first link 135. A second arm pad 141 is formed integrally with the second link 137 to position the right arm, wrist and hand of the golfer relative to the grip and club in an unalterable position.

The arm pads 139, 141 extend transversely from the upper end of the gripper plate 125 when the hands are used to hold the gripper plate 125 against the grip 21 to establish an unalterable position of the forearms, wrists and hands with respect to the grip 21 and club 19. This necessitates the use of only arm movement during a putting stroke, and further, establishes one relationship of both arms with respect to the grip 21 and club 19. This eliminates wrist movement and relative movement between the arm, with increased accuracy.

There should be no rotational movement of the arms in a putting stroke, which is eliminated by the use of two arm pads as shown in FIGS. 1–3 and 7–9. Also, as indicated in FIG. 2, the use of the two pads positioned as indicated causes the golfer to grip the club in the life line, which is appropriate for putting.

Thus, the use of two pads, one for each arm as shown in FIGS. 1–3 and 7–9 causes the golfer to use the proper putting grip and reduces movements between the arms and movement of the wrists to produce an accurate putting stroke. The use of one pad as shown in FIGS. 4–6 causes the golfer to use the grip appropriate for the chipping and pitching stroke and eliminates angular movement of the left arm and wrist relative to the grip 21.

Moreover, the embodiment illustrated in FIG. 7–9, while not provided with the adjustability of the other embodiments, being integrally formed of plastic, aluminum, or the like, presents more a easily manufactured embodiment that can be provided at low cost in a variety of sizes to accommodate golfers of varying size.

While I have shown my invention in only a few of its forms, it should be apparent to those skilled in the art that it is not thus limited but is susceptible to various changes and modifications without departing from the scope and spirit thereof.

I claim:

1. A golf instructional device for use with a conventional golf club and grip to teach and reinforce the touch and feel of strokes that establish accurate paths of golf balls around the greens, comprising:

a support member adapted to be held against and parallel to the grip of the club for use by a practicing golfer;

a cap formed integrally with the support member;

a linking means having a pair of generally opposite ends extending generally traversely from, and integrally formed with, the cap; and a first and second arm pad formed integrally with each of the opposite ends of the linking means to position each of the practicing golfer's arms in an unalterable position.

2. The invention defined by claim 1 wherein the support member is an elongated gripper plate to extend from a mid region of the grip, for confinement by the golfer's hand, to the upper end of the grip.

3. The invention defined by claim 1 wherein the cap further includes an elastomeric member for frictional engagement with an upper end of the grip of the club.

4. The invention defined by claim 1 wherein the support member is formed of metal and the cap, linking means, and arm pads are formed of plastic integrally molded around the gripper plate.

5. A golf instructional device for use with a conventional golf club and grip to teach and reinforce the touch and feel of strokes that establish accurate paths of golf balls around the greens, comprising:

an elongated gripper plate to be held against and parallel to the grip of the club, the gripper plate extending from a mid region of the grip, for confinement by the golfer's hand, to an upper end of the grip;

a cap integrally formed with the support member;

a first link with one end integrally connected to the cap and the other end extending from the cap a selected distance generally transversely from support member;

a first arm pad integrally formed with the other end of the first link to position one of the golfer's lower arms relative to the grip and club in an unalterable position;

a second link with one end integrally connected to the cap and the other end extending from the cap a selected distance generally transversely from the support member and opposite the first link;

a second arm pad integrally formed with the other end of the second link to position the other of the golfer's arms relative to the grip and club in an unalterable position.

6. The invention defined by claim 5 wherein the cap further includes an elastomeric member for frictional engagement with an upper end of the grip of the club.

7. The invention defined by claim 5 wherein the elongated gripper plate is formed of metal and the cap, links, and arm pads are formed of plastic integrally molded about the gripper plate.

8. A golf instructional device for use with a conventional golf club and grip to teach and reinforce the touch and feel of strokes that establish accurate paths of golf balls around the greens, comprising:

a support member adapted to be held against and parallel to the grip of the club for use by a practicing golfer;

a cap integrally formed with the support member, the cap including an elastomeric member secured thereto for frictional engagement with the upper end of the grip;

a first link with one end integrally connected to the coupler and the other end extending from the cap a selected distance generally transversely from support member;

a first arm pad integrally formed with the other end of the first link to position one of the golfer's lower arms relative to the grip and club in an unalterable position;

a second link with one end integrally connected to the cap and the other end extending from the cap a selected distance generally transversely from the support member and opposite the first link; and a second arm pad integrally formed with the second link to position the other of the golfer's arms relative to the grip and club in an unalterable position.

9. The invention defined by claim 8 wherein the support member is formed of metal and the cap, links, and arm pads are formed of plastic integrally molded about the gripper plate.

* * * * *